US006533612B1

(12) United States Patent
Lee et al.

(10) Patent No.: US 6,533,612 B1
(45) Date of Patent: Mar. 18, 2003

(54) CONNECTOR WITH IMPROVED POSITIONING STRUCTURE

(75) Inventors: Fred Lee, Yungho (TW); Mark Chen, Taipei (TW); Nelson Tasi, His Chih (TW)

(73) Assignee: Wieson Electronic Co., Ltd., Taipei Hsien (TW)

( * ) Notice: Subject to any disclaimer, the term of this patent is extended or adjusted under 35 U.S.C. 154(b) by 0 days.

(21) Appl. No.: 09/935,643

(22) Filed: Aug. 24, 2001

(51) Int. Cl.[7] ..... H01R 13/648
(52) U.S. Cl. ..... 439/607; 439/939
(58) Field of Search ..... 439/564, 939, 439/609, 607, 701

(56) References Cited

U.S. PATENT DOCUMENTS 5,637,015 A * 6/1997 Tan et al. ..... 439/609

* cited by examiner

*Primary Examiner*—Javaid Nasri
(74) *Attorney, Agent, or Firm*—Rosenberg, Klein & Lee

(57) ABSTRACT

A connector with improved positioning structure, comprising a casing, a connector unit and a rear unit, the casing using a transverse separating plate to separate a front cover insert hole, allowing the accommodation of two joined universal serial bus USB connector unit in an upper insert hole and a lower insert hole respectively; then a longitudinal separating plate at the center of the transverse separating plate is bent inwardly and pushed closely to a depressed groove on the connector unit, to fasten the casing with the connector unit; since the casing has only insert holes exposed from the connector unit, without using screw holes in conventional models, the entire unit is capable of avoiding such problem of incorrect alignment of screw holes with connector's insert holes as can be found frequently in conventional machining process.

3 Claims, 3 Drawing Sheets

CONNECTOR WITH IMPROVED POSITIONING STRUCTURE

BACKGROUND OF THE INVENTION (a) Field of the Invention

This invention relates to a connector with improved positioning structure, particularly to an innovated casing structure designed for Universal Serial Bus, USB connector, for the purpose of secure fastening of the casing onto the connector, avoiding excessive clearance and dislocation that could result in poor performance of the product; and avoiding incorrect alignment of screw holes with insert grooves as are frequently seen in conventional models.

(b) Description of the Prior Art

FIG. 1 illustrates an exploded view of a prior art of USB connector, wherein, connector units 10A are inserted through an insert hole 21A and are joined to a casing 20A, screws 30A are then inserted through screw holes 22A in the screw holes 11A, to join the connector unit 10A with the casing 20A.

The prior art of connector involves the machining process on the casing 20A of insert holes 21A and screw holes 22A on the casing 20A. As a result of the machining process, the insert holes 21A and screw holes 22A are often misaligned, so the casing 20A could not properly match the connector unit 10A. There is the problem of excessive clearance between the connector unit 10A and the insert holes 21A, which means they could not be assembled properly. Furthermore, there are the problems occurring in operation, such as extraneous matter or static charge. As described above, the prior art of USB connector casing due to insert holes of the casing do involve inconveniences and shortcomings that need improvement.

SUMMARY OF THE INVENTION

The primary objective of the invention is to provide a connector with improved positioning structure that can effectively reduce the frequency of detective casing during production process, to reduce production costs by avoiding the occurrence of defective products.

The second objective of the invention is to provide a connector with improved positioning structure, having a casing with a metal-made front cover to prevent poor performance that may be caused by Electro-Magnetic Interference, (EMI), thereby protecting the interior electronic components and extending the service life of the product.

To achieve the above objectives, the present invention provides a connector with improved positioning structure, comprising a casing, a connector unit and a rear unit, wherein, the casing has a front cover, the front cover having a transverse separating plate and a longitudinal separating plate, for the purpose of fastening the connector; the transverse separating plate is located at the center of the front cover insert holes, separating the front cover insert holes into two parts, an upper part and a lower part, crossing a left side and a right side of the front cover insert hole to join with the casing, to expose a pair of USB connector units; the longitudinal separating plate is installed at the center of the transverse separating plate, extending a specified distance upward and downward respectively; the longitudinal separating plate is optionally a bendable plate that is bent after the connector is installed properly, so a bent part can be fastened securely to a depressed groove of the connector.

BRIEF DESCRIPTION OF DRAWINGS

The following and other features and advantages of the present invention will be more easily understood from the following detailed description and the accompanying drawings, in which.

DETAILED DESCRIPTION OF PREFERRED EMBODIMENTS

Figure 1:
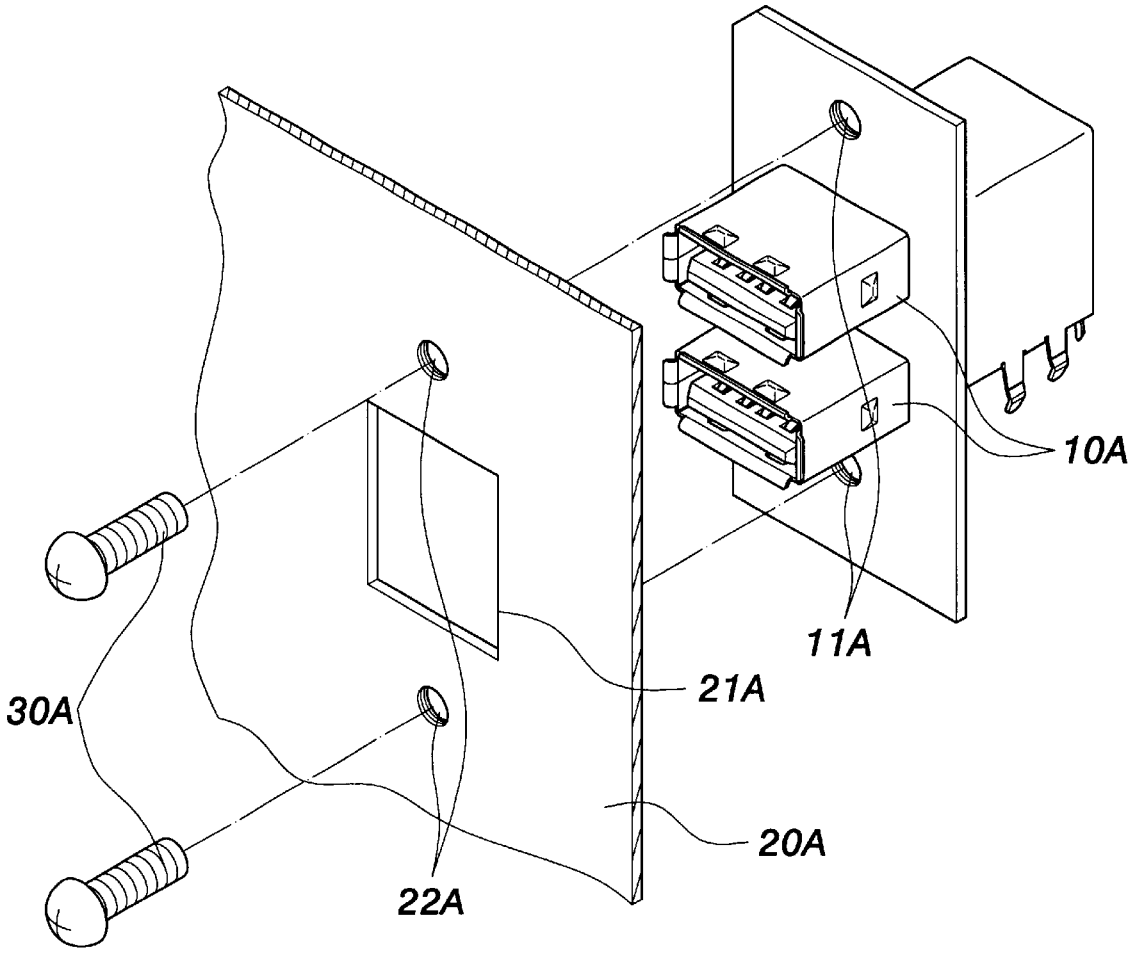
FIG. 1 PRIOR ART
FIG. 1 is an exploded view of a prior art of USB connector.
Figure 2:
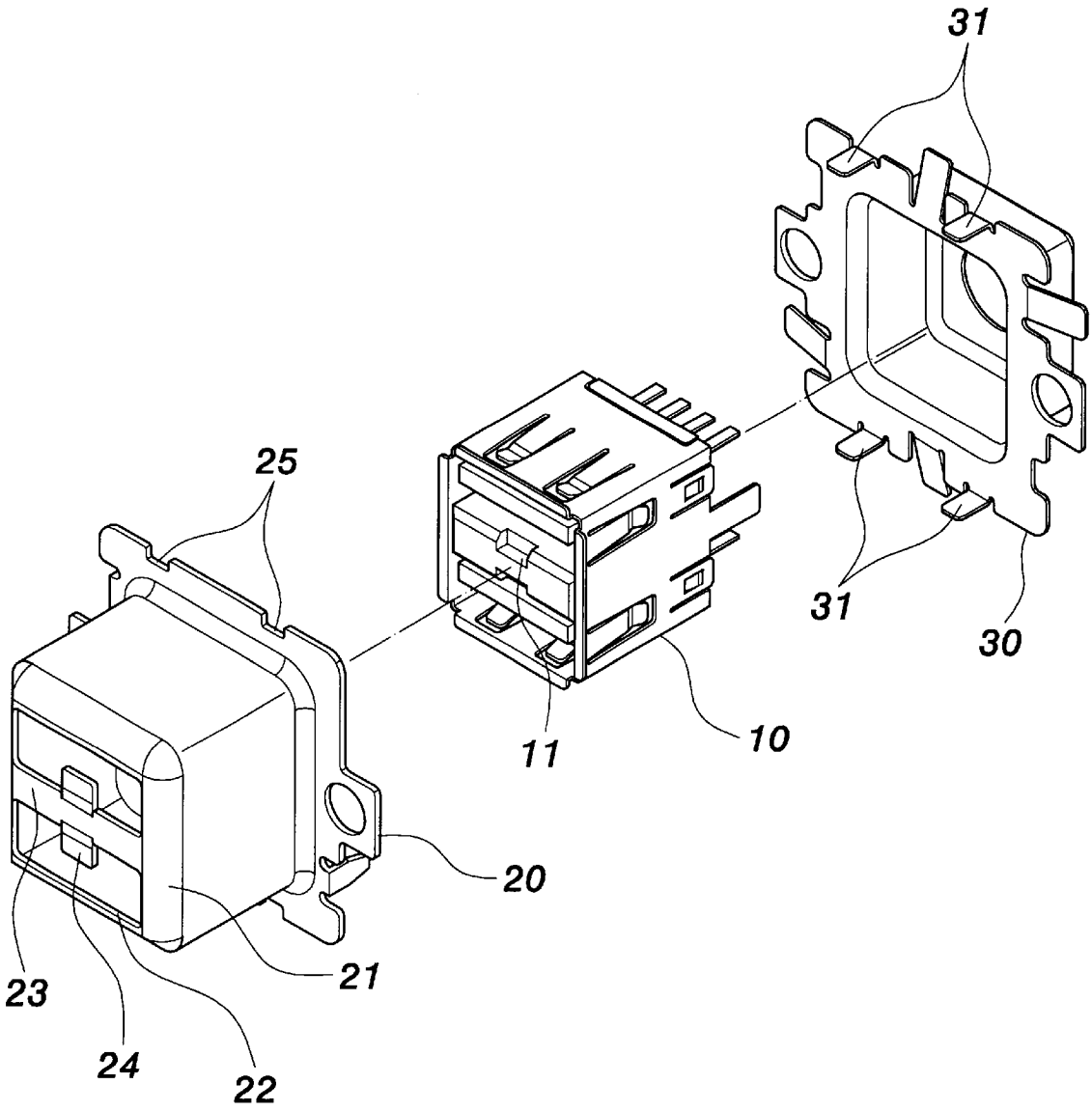
FIG. 2 is an exploded view of the invention.

FIG. 2 illustrates a perspective view of the present invention comprising a connector unit 10, a casing 20 and a rear unit 30; wherein the casing 20 is connected with the connector unit 10, then, the casing 20 and the connector unit 10 are joined with the rear unit 30.

The casing 20 has a set of joining grooves 25 and a front cover 21. The front cover 21 has a front cover insert hole 22, a transverse separating plate 23 and a bendable longitudinal separating plate 24. The transverse separating plate 23 is installed at the center of the front cover insert hole 22, crossing a left side and a right side of the front cover insert hole 22 and extending outwardly to join with the front cover 21, separating the front cover insert hole 22 into two parts, an upper part and a lower part, to correspond with the connector unit 10. The longitudinal separating plate 24 is installed at the center of the transverse separating plate 23, extending upward and downward respectively. The connector unit 10 is installed inside the front cover 21 of the casing 20. After the connector unit 10 is installed properly, the longitudinal separating plate 24 is bent inwardly and fastened onto a depressed groove 11 on the connector unit 10, so as to serve the purpose of fastening the casing 20 with the connector unit 10.

The rear unit 30 has a set of bendable joining plates 31 that are installed thereto. After the casing 20 is assembled to the connector unit 10, the rear unit 30 is joined to the connector unit 10, then, the joining plates 31 are bent to fasten onto the joining groove 25.

Figure 3:
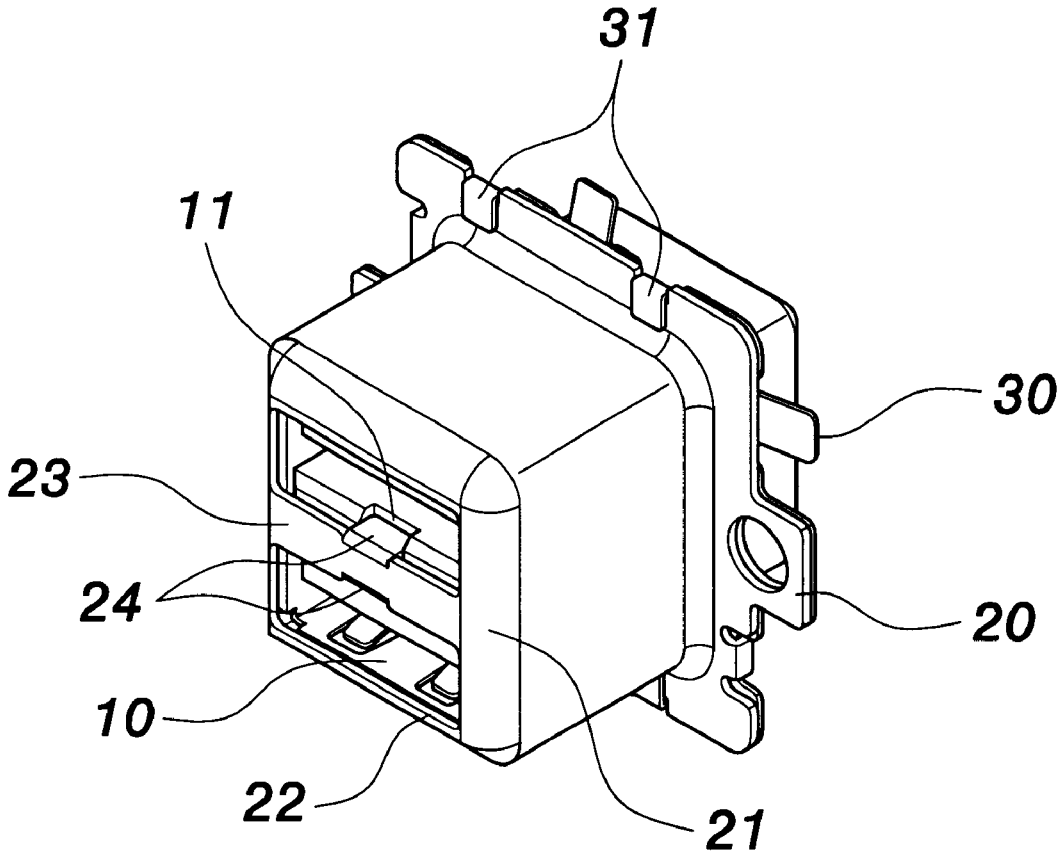
FIG. 3 is a perspective, assembled view of the invention.

FIG. 3 illustrates the invention when it is assembled properly. The longitudinal separating plate 24 snaps and joins with the depressed groove 11. Since the front cover 21 of the invention is made of metal, it effectively prevents the problems of EMI frequently seen on regular electrical appliances.

The present invention of positioning mechanism for connector is characterized in that:

(1) Instead of using conventional screw holes, the invention has a front cover on the casing that can be directly mounted onto a connector unit for convenient positioning purpose, avoiding the problem of improper machining on the connector casing.

(2) Reduction of costs resulting from improper machining process.

(3) Prevention of Electro-Magnetic Interference (EMI) that is frequently seen in conventional electrical appliances.

To conclude, the present invention has satisfied the requirements for a patent right, therefore this application is duly filed in accordance with the patent law. Your favorable consideration will be appreciated.

Although the present invention has been illustrated and described with reference to the preferred embodiment thereof, it should be understood that it is in no way limited to the details of such embodiment but is capable of numerous modifications within the scope of the appended claims.

What is claimed is:

1. A connector with improved positioning structure, comprising:

a connector unit having at least one depressed groove formed thereon;

a casing including a peripheral portion having a set of joining grooves coupled to a front cover, the front cover defining a front cover insert hole and having at least one transverse separating plate and a longitudinal separating plate extending therefrom; wherein the longitudinal separating plate is fastened to the depressed groove of the connector unit after the connector unit is installed to the front cover insert hole; and a rear unit joined to a rear side of the connector unit, the rear unit having formed thereon a set of joining plates bendably engaging the joining grooves of the casing.

2. The connector with improved positioning structure as claimed in claim 1, wherein the transverse separating plate crosses a left side and a right side of the front cover and is connected with margins of the casing.

3. The connector with improved positioning structure as claimed in claim 1, wherein the longitudinal separating plate is located at a center of the transverse separating plate, extending a specified distance.

* * * * *